US010513841B1

(12) United States Patent
Robillard et al.

(10) Patent No.: US 10,513,841 B1
(45) Date of Patent: Dec. 24, 2019

(54) SINK STRAINER ASSEMBLY

(71) Applicants: Russell W. Robillard, Baton Rouge, LA (US); Fred W. Robillard, Baton Rouge, LA (US)

(72) Inventors: Russell W. Robillard, Baton Rouge, LA (US); Fred W. Robillard, Baton Rouge, LA (US)

(73) Assignee: PERMADRAIN, LLC, Baton Rouge, LA (US)

( * ) Notice: Subject to any disclaimer, the term of this patent is extended or adjusted under 35 U.S.C. 154(b) by 0 days.

(21) Appl. No.: 15/599,593

(22) Filed: May 19, 2017

Related U.S. Application Data

(60) Provisional application No. 62/339,683, filed on May 20, 2016.

(51) Int. Cl.
*E03C 1/264* (2006.01)

(52) U.S. Cl.
CPC ..... *E03C 1/264* (2013.01)

(58) Field of Classification Search
CPC ..... E03C 1/264
USPC ..... 4/286–295, 650, 652, 688–693
See application file for complete search history.

(56) References Cited

U.S. PATENT DOCUMENTS 2,611,135 A * 9/1952 Greene ..... A47K 3/281 108/24
4,825,477 A * 5/1989 Aranda ..... E03C 1/262 4/286
5,050,247 A * 9/1991 Hsu ..... E03C 1/23 4/292
2015/0089729 A1* 4/2015 Usher ..... E03C 1/264 4/292

* cited by examiner

*Primary Examiner* — Christine J Skubinna
(74) *Attorney, Agent, or Firm* — Roy Kiesel Ford Doody & North, APLC

(57) ABSTRACT

A sink strainer assembly for attachment to a clamping ring of a sink waste valve assembly comprising a strainer sized to fit within and be attachable to the clamping ring by a locking bar attachable to the clamping ring and at least one or more screws affixing the strainer to the locking bar, the improvement to which comprises (a) the strainer comprising a cylindrical body having top and bottom surfaces provided with passageways extending from the top surface and extending through the bottom surface to permit fluids to pass through the strainer, a channel cut in the bottom surface and having a post cavity of greater depth than the channel, a screw passageway extending from the bottom of the post cavity through the top surface of the strainer body; (b) the locking bar comprising an elongated slat member having a width greater than the depth of the channel and a length sized to fit in the channel, the slat having a post member sized to fit into the post cavity, the post member having an axial passageway formed by a threaded interior wall and positioned on the slat member to be aligned to the screw passageway when the locking bar is positioned in the channel, the slat having its opposing end sections forming a shoulder extendable beneath the clamping ring lower rim when the strainer is positioned in the clamping ring; and (c) a screw sized and shaped to fit into the screw passageway and be operatively engaged with the threaded interior wall of the post member.

14 Claims, 7 Drawing Sheets

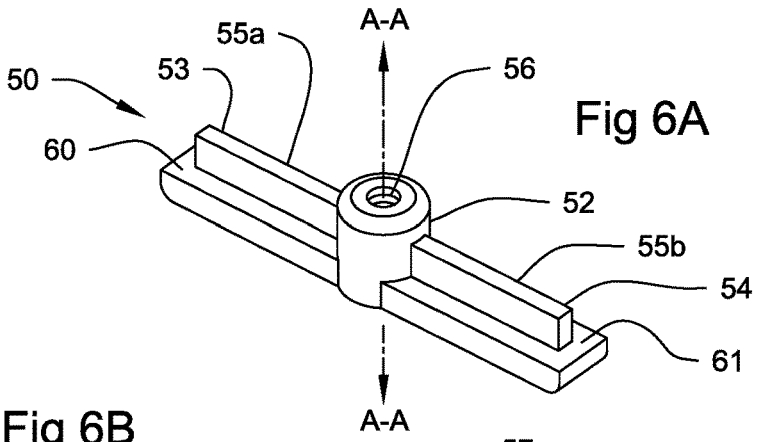
Fig 6A
Fig 6B
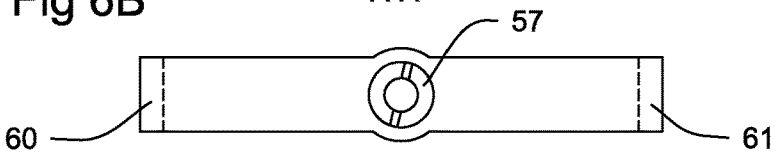
Fig 6C
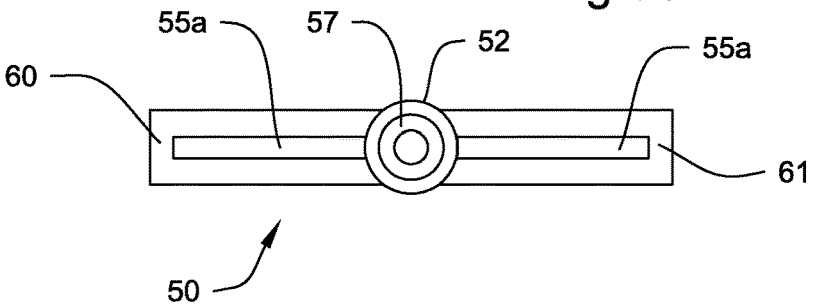
Fig 6D
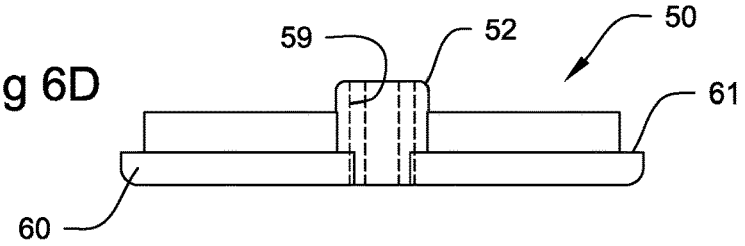
Fig 6E
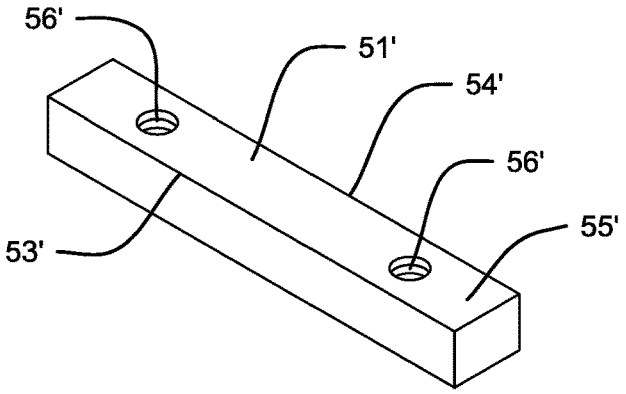

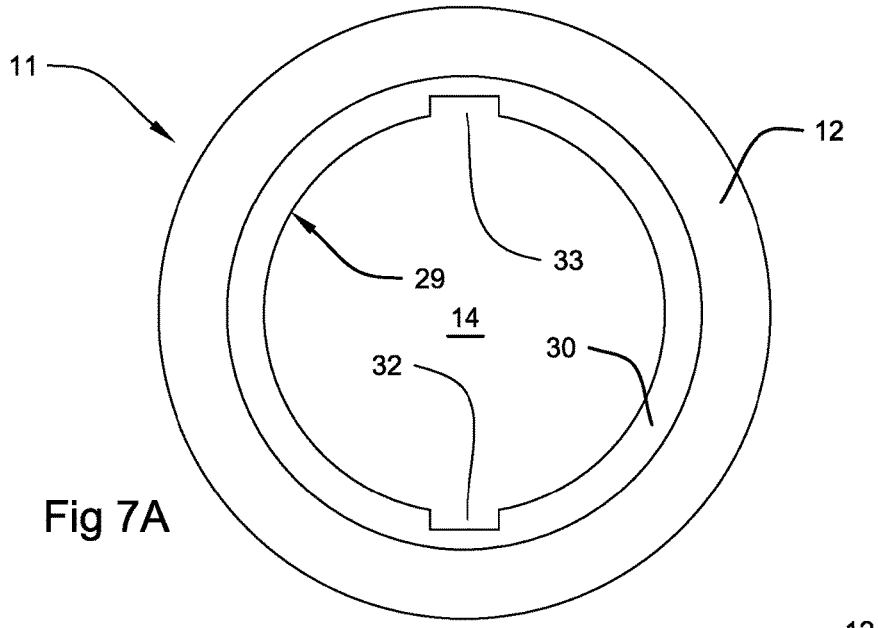
Fig 7A
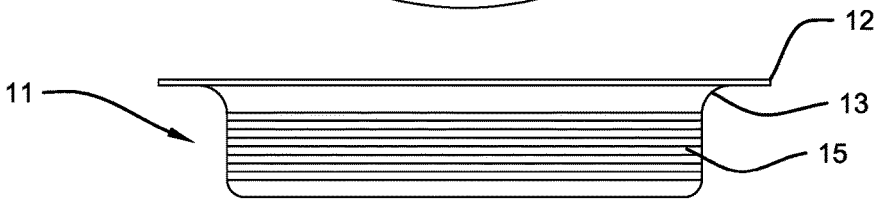
Fig 7B
Fig 7C
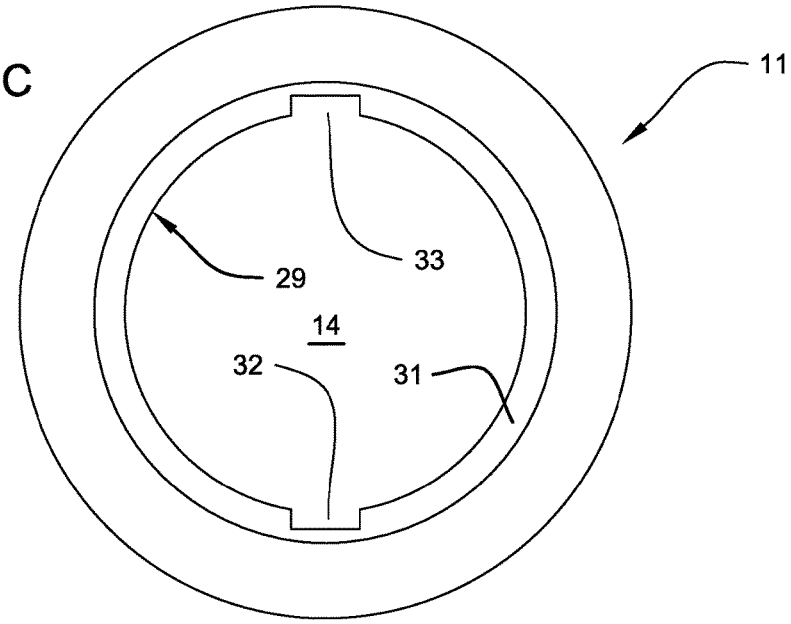

SINK STRAINER ASSEMBLY

CROSS REFERENCE TO RELATED APPLICATIONS

This application claims the benefit of U.S. Provisional Application No. 62/339,683, filed May 20, 2016, and which is hereby incorporated by reference in its entirety.

BACKGROUND OF THE INVENTION

Field of the Invention

This invention relates in general to strainer assemblies for use with sink drainage systems, and more particularly to strainers attachable to a conventional clamping ring affixed to a waste valve body.

Prior Art

Most sinks utilize strainers to prevent large food particles or other foreign matter such as forks, spoons, knives, and other cooking utensils, as well as tin cans and plastic lids from falling into and clogging the sink drain pipes.

Unless prevented many of these materials will enter the drain pipe forming part of the building drain system where they can become stuck and eventually create a blockage in the building drain system and/or even the sewer system when the two system are operatively connected. Such blockage can prevent the liquid and smaller solid waste materials from passing through the drain pipe to the sewer system. When this occurs it is necessary to attempt to remove from the building drain system the material that has created the blockage. This is not only time consuming, but in many instances not possible without breaking up and tearing out sections of the concrete flooring to permit access to the area of the drain pipe that is blocked.

One common sink waste disposal system includes a waste valve affixed underneath the sink basin to receive water and waste accumulated in the sink well for discharging into the building drainage system. To prevent forks, knives, spoons and other utensils or other large objects that might clog the drain pipes in the building drainage system, the waste valve body has a threaded throat section to which a clamping ring can be screwed. To ensure that all material cannot leak around the clamping ring, a ring gasket is positioned on the upper rim of the waste valve and between the upper rim and the bottom surface of the sink floor around the sink floor drain hole whereby when the clamping ring is screwed down it forces the sink floor to press against the gasket forming a water tight seal with the waste valve, as well as forms when the clamping ring upper lip contacts the upper surface of the sink floor. The clamping ring is provided with a lower circular ledge extending into the central passageway. The ledge is provided with two gaps positioned opposite one another. The prior art strainer includes a thin metal disk having multiple drain opening with four legs member extending downward into the clamping ring and bent outward to exert pressure against the side walls of the clamping ring to restrain movement of the strainer when positioned in the clamping ring. To hold the strainer in place in the clamping ring, it is known to use a metal bar. The metal bar has a length that extends adjacent opposite side wall of the strainer and a width less than the width of the gaps of the ledge. The metal bar has notches cut into its opposite ends sized to allow the metal bar ends to fit above and below the ledge and rotate around the ledge. The top side of the metal bar will have a threaded channel to accommodate a bolt or screw that can extend through one of the strainer's central openings to be screwed into the threaded channel. When the screw is threaded into the treaded channel it forces the notched end section into contact with the ledge to prevent movement of the bar thus holding the strainer in the desired position.

Several principal problems exist with these prior art strainers. First, the strainer assembly is not easily attached to the clamping ring. There are several methods utilized in attempting to make the attachment. In one method the locking bar is first positioned on the retaining lip of the clamping ring. It is desired to position the screw opening in the locking bar in the center of the clamping ring. However, because of the loose tolerance necessary the locking bar can easily be moved. The strainer with its bendable legs designed to press against the side walls of the clamping ring to hold the strainer in position in the clamping ring is next positioned in the clamping ring. One then inserts the screw through the strainer center opening and attempts to stab the screw into the locking bar screw opening. Because the strainer partially blocks the view the attempt to align the screw into the screw opening can easily result in the locking bar being moved out of position. To eliminate that problem a second method is to first attach the locking bar and strainer together with the screw and then position them into the clamping ring. However, because the locking bar rotates easily about the clamping ring rim it is difficult to tighten the locking bar against rim. Regardless of which method is used, it is time consuming to make the attachment. Another problem created is the accidental dropping of the screw down the drain while trying to attach the strainer assembly to the clamping ring. Yet another problem with these prior art strainer assembly is both the strainer legs used to maintain the strainer in proper position become bent. In addition the flat strainer can become bent when pots and other heavy cooking utensils are dropped on the strainer. This can cause undesired leaks about the strainer edges, as well create problem when trying to replace the bent strainer. Still further, the prior art strainer can be easily removed by removing the screw with a simple screwdriver. Thus, this system is not as vandal proof as is desired.

OBJECTS AND SUMMARY OF THE INVENTION

Therefore, one object of this invention is to provide a strainer that can be operatively used with a sink drain.

Another object of this invention is to provide a sink drain with a strainer that can be quickly and easily installed to form a sealing arrangement with the clamping ring of the waste valve assembly.

A still other object of this invention is to provide a sink strainer that will effectively block solid or food objects that enter the sink drain from entering the drain pipe and create a blockage in the building drain system.

A still further object of this invention is to provide a strainer that can be removed easily and quickly by authorized personnel should it be necessary to clean the sink well or the strainer or have access to the discharge pipe, and that can then be easily and quickly re-installed.

Other objects and advantages of this invention shall become apparent from the ensuing descriptions of the invention.

Accordingly, a sink strainer assembly for attachment to a clamping ring of a sink waste valve assembly comprising a strainer sized to fit within and be attachable to the clamping ring by a locking bar attachable to the clamping ring and at least one or more screws affixing the strainer to the locking bar, the improvement to which comprises (a) the strainer comprising a cylindrical body having top and bottom surfaces provided with fluid flow passageways extending from the top surface and extending through the bottom surface of the body to permit fluids to pass through the strainer, a channel cut in the bottom surface and having at least one post cavity of greater depth than the channel, a screw passageway extending from the bottom of the post cavity through the top surface of the strainer body; (b) the locking bar comprising an elongated slat member having a width greater than the depth of the channel and a length sized to fit in the channel, the slat having a post member sized to fit into the post cavity, the post member having an axial passageway formed by a threaded interior wall and positioned on the slat member to be aligned to the screw passageway when the locking bar is positioned in the channel, the slat having its opposing end sections forming a shoulder extendable beneath the clamping ring lower rim when the strainer is positioned in the clamping ring; and (c) a screw sized and shaped to fit into the screw passageway and be operatively engaged with the threaded interior wall of the post member.

In another preferred embodiment the channel has a post cavity at each of its opposing end sections with a corresponding screw passageway extending from the bottom of each of the two post cavities through the top surface of the strainer body.

In another preferred embodiment the channel extends through the center of the bottom surface and had a depth of less than ¼ inch, and the post cavity has a depth greater than the channel.

In another preferred embodiment the strainer channel is provided with a post cavity and corresponding screw passageway at each of its opposing end sections. In this embodiment the locking bar is provided with two post members positioned to fit into a corresponding post cavity. In a more preferred embodiment the axial passageway in each of the post members is formed utilizing a brass, aluminum, stainless steel, or other non-rusting metal tube having a threaded interior wall sized to operatively receive its respective screw.

In another preferred embodiment the screw passageway is flared at its top section to form a recessed seat sized to hold the screw head to form a more uniform flat top surface of the strainer. It is also preferred that the screw has a hex socket head with a center guide member extending upward from the bottom of the hex socket floor that aids in preventing a different shaped screwdriver from fitting into the hex socket cavity.

In a more preferred embodiment the multiple fluid passageways have individual cross-sectional areas to permit fluid and solid particles having a diameter less than ½ inch to flow through the passageways.

In another preferred embodiment it is preferred that the strainer be constructed from rigid, hard plastic material that will not bend or become dented during use. In a more preferred embodiment it is preferred that the exterior side wall surface be smooth and constructed to have a low coefficient of friction to permit the strainer to rotate easily when positioned in the clamping ring.

In another preferred embodiment each of the fluid passageways will have a smaller opening at the top surface and be sloped to form a larger opening at the bottom surface of the strainer.

The foregoing has outlined rather broadly the features and technical advantages of the present invention in order that the detailed description of the invention that follows may be understood. Additional features and advantages of the invention will be described hereinafter which form the subject of the claims of the invention. For example this invention can be used with floor drains, as well as sink drains. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

The accompanying drawings describe and/or illustrate the prior art and a preferred embodiment of this invention utilized with a commercial kitchen sink. However, it is to be understood that this embodiment is not intended to be exhaustive, nor limiting of the invention. It is but one example of the construction of this invention.

FIG. 6A is a three quarter view of the restraining member when using only one screw.

FIG. 6B is a bottom view of the restraining member illustrated in FIG. 6A.

FIG. 6C is a top view of the restraining member illustrated in FIG. 6A.

FIG. 6D is a side view of the restraining member illustrated in FIG. 6A.

FIG. 6E is a three-quarter perspective view of an alternate structure of the strainer assembly security member that can be used with the invention.

FIG. 7A is a top view of the securing ring illustrated in FIG. 2.

FIG. 7B is a side view of the securing ring illustrated in FIG. 2.

FIG. 7C is a bottom view of the securing ring illustrated in FIG. 2.

PREFERRED EMBODIMENTS OF THE INVENTION

Without any intent to limit the scope of this invention, reference is made to the figures in describing the preferred embodiments of the invention.

There are various configurations of standard commercial kitchen sinks. Generally, each sink has a basin formed by one or more walls and a floor provided with a drain opening. The cavity of the basin is often referred to as the well and is where plates, utensils, pots, pans and other cooking devices are rinsed. There will be a lower waste discharge assembly extending downward from drain opening in the sink floor. It is common that the assembly will include a waste valve between the drain opening and the lower waste discharge tube. The discharge tube will be operatively connected to a drain pipe forming part of the building drain system so that liquid waste material in the sink well will pass into the drain pipe.

Figure 1:
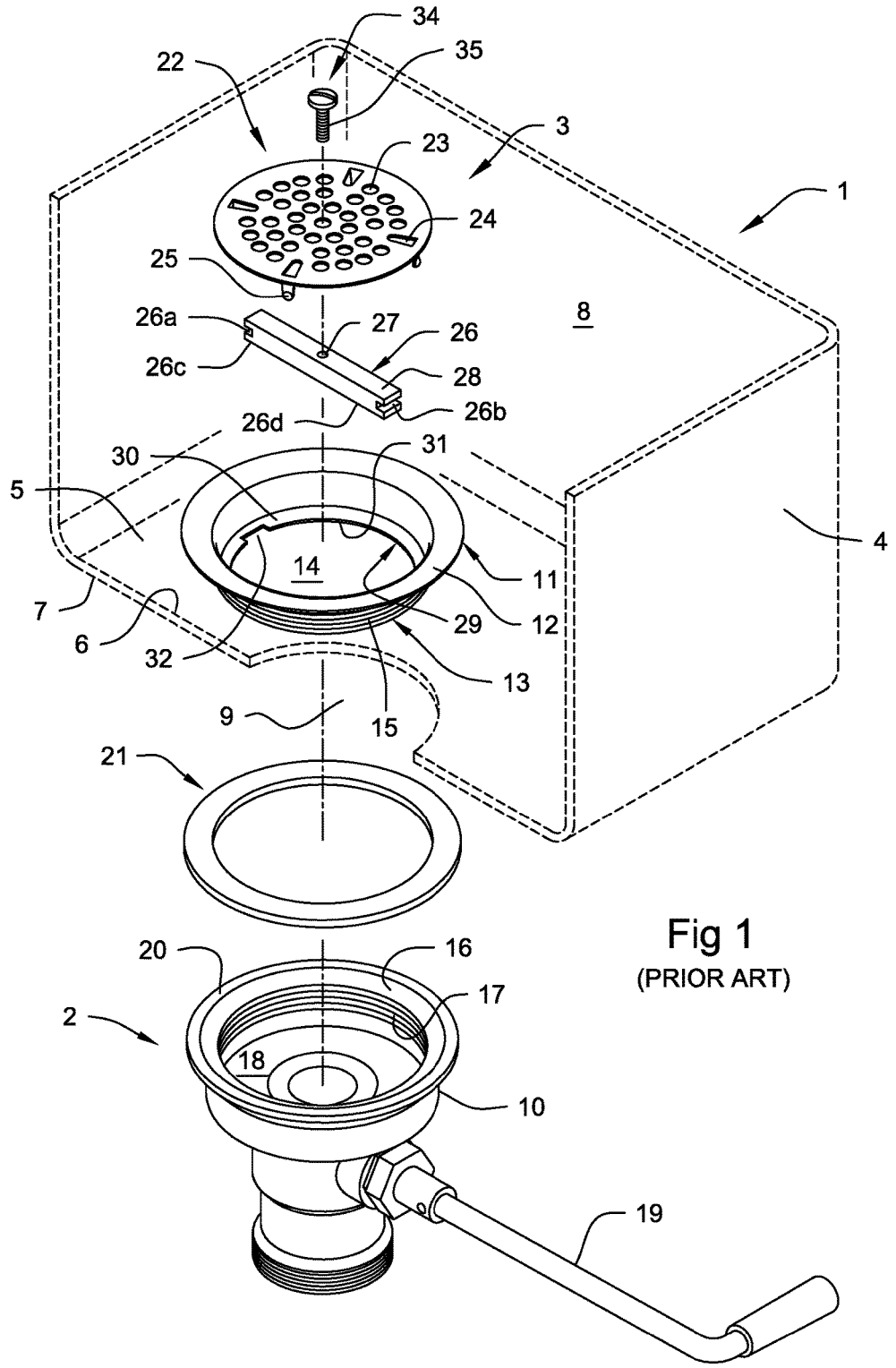
Fig 1 (PRIOR ART)
FIG. 1 is an exploded view of a prior art strainer assembly that includes a thin metal disk-shaped strainer, an elongated flat plate and a bolt or screw construction used in conjunction with a commercial sink drain assembly including a conventional waste valve, securing ring, and gasket that affixes the waste valve to the floor surface of the sink basin when the securing ring is fully threaded into the throat area of the waste valve to form a seal between the waste valve upper rim and the sink basin floor lower surface and form a seal between the securing ring lip section and sink basin floor upper surface.

FIG. 1 is an exploded view illustrating a prior art sink drain assembly including the sink basin 1, a waste valve assembly 2 and a strainer assembly 3. The sink basin 1 typically has vertical walls 4 and a floor 5 having a top surface 6 and a bottom surface 7 forming a well 8. The well 8 is used to collect food and other waste particles rinsed off of dirty plates, pots and utensils. The floor 5 in the bottom area of the well 8 is provided with a drain opening 9 to permit the collected food and other small waste particles to be rinsed into the strainer assembly 3 and then passed to the waste valve assembly 2 and ultimately into the building discharge pipes (not shown) that lead generally to a sewer line. The primary function of the waste valve assembly 2 and the strainer assembly 3 is to prevent larger objects from be rinsed into the building drainage pipes which may cause a blockage and backup of the waste into the well 8.

A conventional waste valve assembly 2 includes a waste valve 10 having known means (not shown) that can open, partially open or close the valve 10 to block the passage of material from the well 8 to the building drainage pipes. A typical waste valve 10 is constructed having body wall 16 having a threaded interior surface 17 forming the intake passageway or throat 18. The upper rim 20 of wall 16 is positioned beneath the drain opening 9 whereby food and other matter exiting drain opening 9 will be captured by the throat 18. The waste valve 10 is held in the desired position by a securing ring 11. As seen in FIGS. 1-2 and FIGS. 7A-7C, the securing ring 11 is tubular in shape having an upper lip 12 that will seat around the perimeter of the drain opening 9 when the securing ring 11 is inserted through the drain opening 9. The outer wall surface 13 of the securing ring 11 is threaded for the purpose of screwing the securing ring 11 into the threaded interior surface 17 of wall 16 forming the intake passageway or throat 18 of the waste valve 4. When the securing ring 11 is fully screwed into valve wall 16 the securing ring upper lip 10 forms a water tight seal with the top surface 6 of the basin floor 5. A gasket 21 is positioned on the waste valve upper rim 20 to ensure no leakage occurs between the waste valve upper rim 20 and the bottom surface 7 of the basin floor 5. Typically, the control means 19 to open and close the waste valve 10 is located underneath a cabinet and is not easily accessible. For that reason the waste valve 10 is generally fully opened to allow fast drainage from the well 8 and is rarely changed from that position except when necessary to prevent a backup from the sewerage and drain pipes into the sink well 8. As a result, with the waste valve 10 in an open position large particles and other materials can enter the waste valve 10 and are not blocked from entering the drainage pipes.

The primary purpose of the strainer assembly 3 is to prevent the large particles and other materials from entering the waste valve 10 while still allowing an adequate flow of the rinse water and food particles to be discharged from the well 8.

As shown in FIG. 1 one known strainer assembly 3 utilizes a flat, thin, metal disk 22 have multiple drainage openings 23 to permit the rinse water and small food particle to be discharged from the well 8 and into the waste valve throat 18. The disk 22 is sized and shaped to fit into the securing ring passageway 14. It is preferred that the disk 22 when positioned in the securing ring 11 be flush with the securing ring upper lip 12 so as not to damage plates and pans placed into the well 8, and to make certain fluid in the well 8 can flow out of well 8. To achieve the desire positioning of the disk 22, securing ring 11 is constructed having a ledge 29 protruding outward from the interior surface of wall 13 of the securing ring 11 at a known distance from its upper lip 12. Sections 24 of the disk surface are then punched to form "legs" 25 that are pushed downward and outward to contact the interior surface of wall 13 of the securing ring 11. The "legs" 25 are of sufficient length so when they contact the top surface 30 of securing ring ledge 29 the disk 22 will be at the same height as the securing ring upper lip 12. In order to maintain the position of the disk 22 during the flow of materials through the disk drainage openings 23, as well as when the disk 22 is struck by the pots and pans dropped into the well 8 it is necessary to secure the disk 22 to the securing ring 11. As illustrated in FIGS. 7A and 7C one known way to do so is to modify the ledge 29 to allow the use of a bar 26 that can be positioned under ledge 29. To get the metal bar 26 underneath ledge 29, ledge 29 is provided with two opposing gaps 32, 33 whereby the metal bar 26 can slip through the gaps 32, 33 to position the notches 26*a* and 26*b* in the opposing bar ends 26*c* and 26*d*, respectively, when rotated to be positioned above and below the metal bar 26. The bar 26 is thus blocked by the ledge 29 from being removed from its position. It is further necessary that opening 33 in the disk 22 be sized to allow a bolt 34 with threaded end 35 to pass through the center bolt opening 23 positioned in the center of metal disk 22 and extend downward to screw into a threaded opening 27 through the top surface 28 of the metal disk 26. As the bolt 34 is threaded into the metal bar 26 the metal bar 26 is forced into contact with the lower surface 31 of the ledge 29 and causes the disk 22 to become fixed in its position.

Although the above strainer assembly can perform its function there are serious difficulties that the improved strainer assembly 3 of this invention solves. Those difficulties include, but are not limited to, maintaining the fixed position of the metal disk 22 when it or its "legs" 25 become bent, visual blockage by the disk 22 of the metal plate threaded opening 27 preventing or significantly increasing the difficulty in quickly threading the bolt 34 to the top threaded opening 27 in the metal bar 26, increased risk of dropping the metal bar 26 or bolt 34 into the waste valve 10, and ease of a person intentionally removing the disk 22 and removing the disk 22 without permission of the restaurant or facility owner.

As seen in FIGS. 2, 2A-2D, in this invention the strainer assembly 3 comprises use of strainer body 36 having top and bottom flat surfaces 37, 38, respectively. As with the disk 22, the strainer body 36 is sized to fit within the securing ring 11. Preferably, strainer body 36 is approximately 0.75 inches in height and 3.375 inches in diameter when used with a 3.5 inch conventional sink drain 9. The height and diameter dimensions can vary depending on the drain size and the shape and size of the securing ring 11. Strainer body 36 has multiple drainage passageways 41 to permit water, other fluids and/or small food and other particles to pass through the strainer body 36 and into the waste valve 10.

Figure 2:
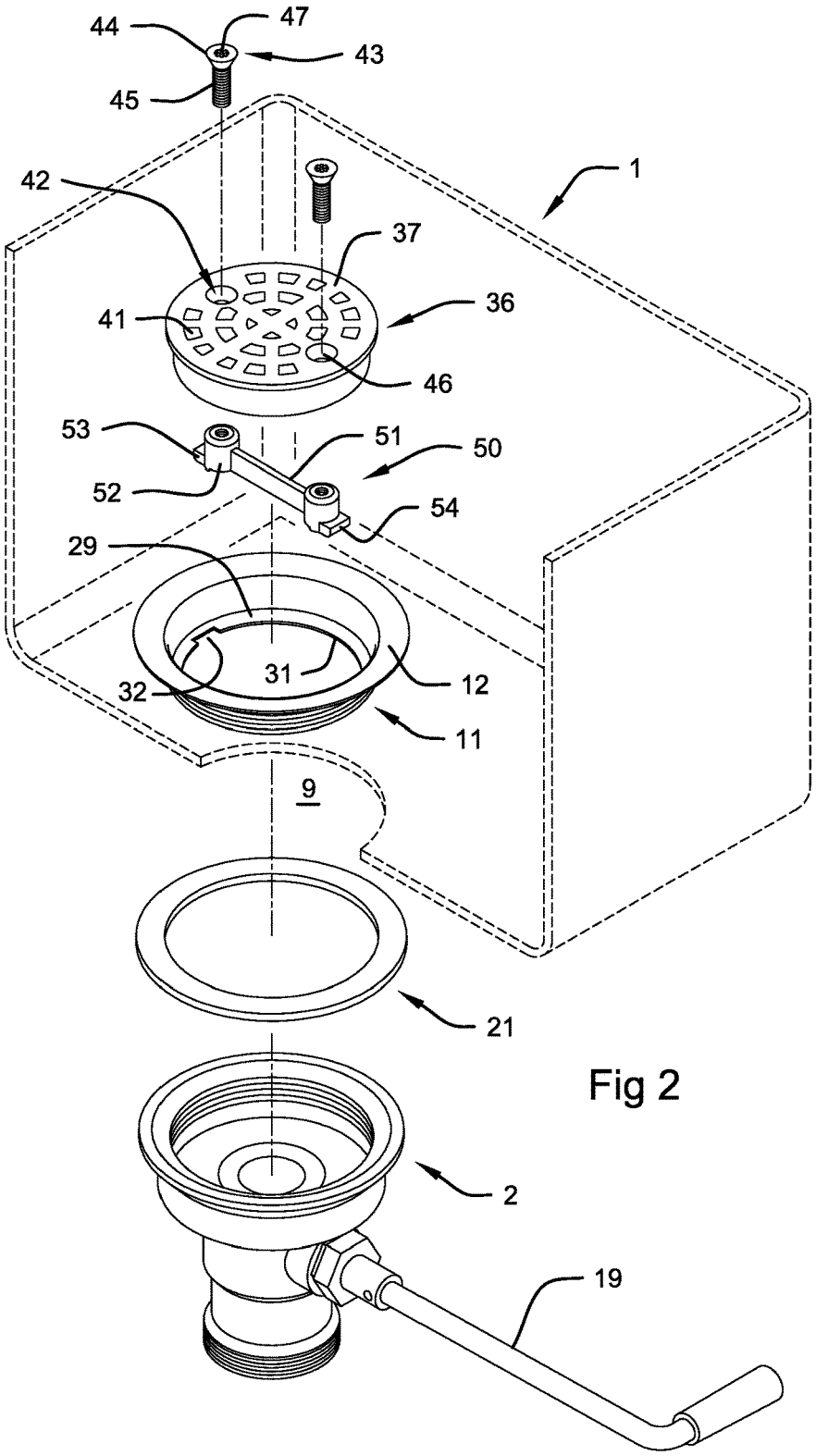
FIG. 2 is an exploded view of a preferred embodiment of the strainer assembly of this invention comprising an improved strainer, improved securing member and improved tamper resistant screw construction
Figure 2A:
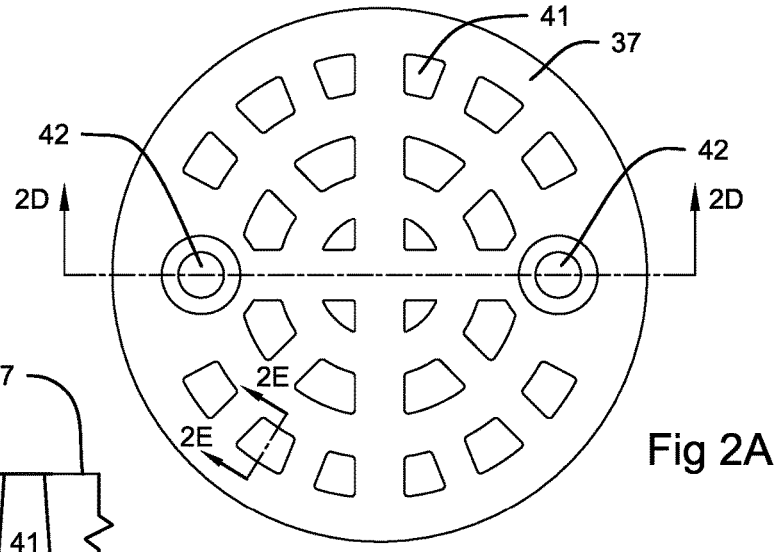
FIG. 2A is a top view of the improved strainer illustrated in FIG. 2 showing the top openings of the multiple waste stream drainage passageways and the two top cavity screw passageways sized to receive and seat the heads of the tamper resistant securing screws illustrated in FIG. 2.
Figure 2E:
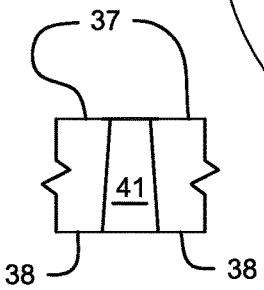
FIG. 2E is a cross-section view taken along lines 2E-2E in FIG. 2A illustrating the preferred shape of the drainage passageways.

Unexpectedly, as seen in FIG. 2E, it has been found that more efficient fluid flow through the strainer body 36 can be achieved if the area of the passageway opening at the top surface 37 is smaller than the area of the passageway opening at the bottom surface 38. A particularly preferred shape of drainage passageway 41 is similar to a truncated inverted tapered polygon with the wider base in the bottom surface 38 and the narrower truncated top in the top surface 37. The number and size of the drainage passageways 41 is set to allow constant fluid flow through the strainer body 36 with little or no fluid backup in the sink well 8. It has been found this can be achieved if the area of the top surface of the drainage passageways 41 should be at least 30% of the total area of top surface 37.

If the strainer body 36 is also provided with one or more screw passageways 42 sized to allow a tamper resistant screw 43 to be inserted into passageway 42 whereby it screw head 44 can be seated into the upper passageway cavity 46 shaped and sized to seat and accommodate all of screw head 44 so that screw head 44 will not extend above strainer body top surface 37.

FIG. 6E illustrates an alternative structure for the strainer assembly securing member 50' of this invention. In a preferred embodiment structure 50' is a solid elongated bar 51' having two threaded openings 56' each positioned in the top surface 55' of opposite end sections 53' and 54', respectively, of the bar 50' whereby each opening 56' will align with one of the screw passageways 42 of strainer body 36. The bar 50' is constructed having a width less than the width of gaps 32 and 33, and a length that will extend under ledge 29 when bar 50' is rotated by rotating strainer body 36.

Figure 4A:
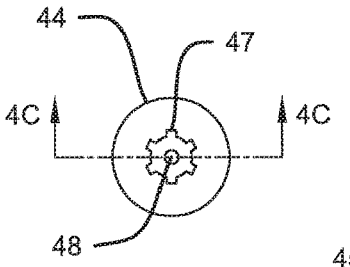
FIG. 4A is a top view of the tamper resistant screw illustrated in FIG. 2.
Figure 4B:
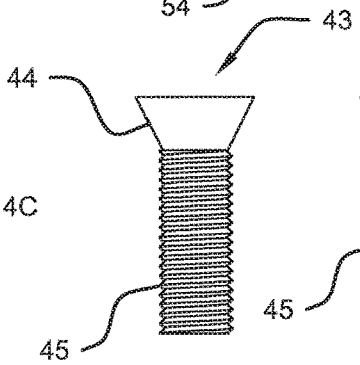
FIG. 4B is a side view of the tamper resistant screw illustrated in FIG. 2.
Figure 4C:
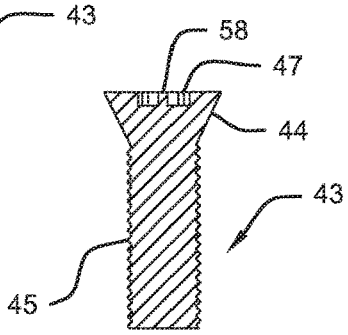
FIG. 4C is a cross-sectional view along lines 4C-4C of FIG. 4A illustrating the circular cross-section stub extending vertically upward from the center of the hex-shaped screw head opening for use to prevent conventional single blade or a Phillips shaped blade of a screwdriver from operatively being inserted into the screw head opening.
Figure 5A:
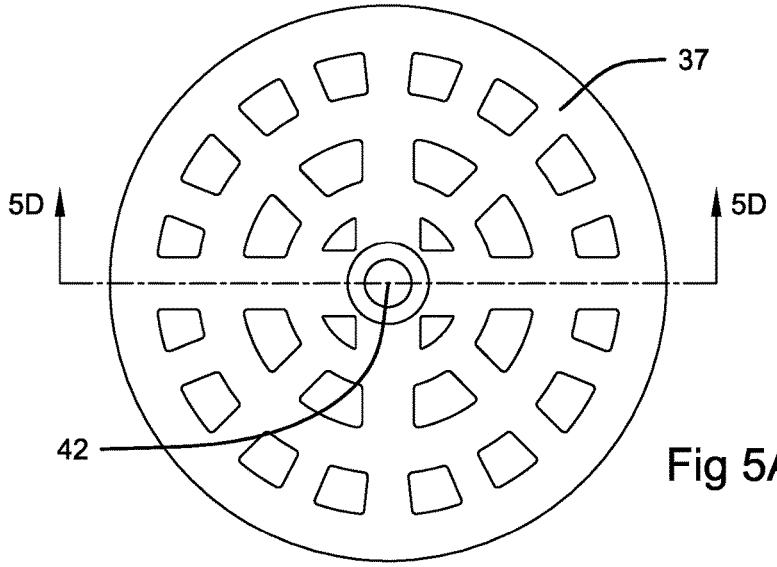
FIG. 5A is a top view of an alternate embodiment of the strainer member utilizing only one screw.
Figure 5B:
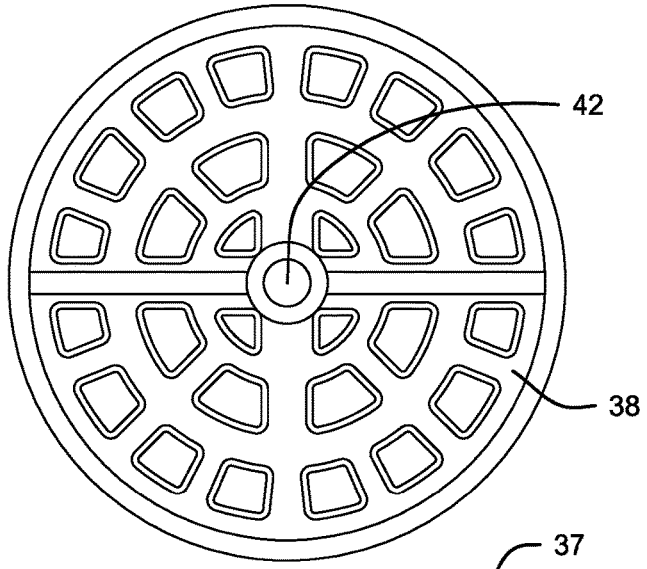
FIG. 5B is a bottom view of an alternate embodiment of the strainer member utilizing only one screw.
Figure 5C:
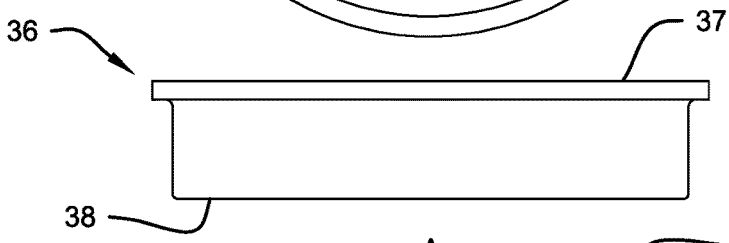
FIG. 5C is a side view of an alternate embodiment of the strainer member utilizing only one screw.
Figure 5D:
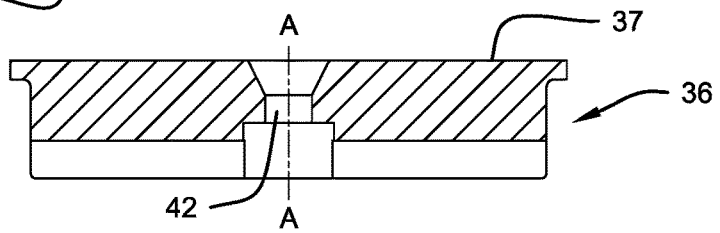
FIG. 5D is a cross-section view taken along lines 5D-5D of FIG. 5A

As seen in FIGS. 4A-4C it is further preferred that the screw head 44 have a flat top surface. To better prevent the screws 43 being intentionally removed and allowing the unauthorized removal of strainer body 36, it is still further preferred that a tamper resistant screw head 44 be used. It is most preferred that the screw head 44 have a 6 lobe or hex-shaped blade opening 47 further modified to have a pin or guide post 48 extending vertically upward from the center of blade opening 47 to block any non-conforming screwdriver blade from being used to remove screws 43.

Figure 2B:
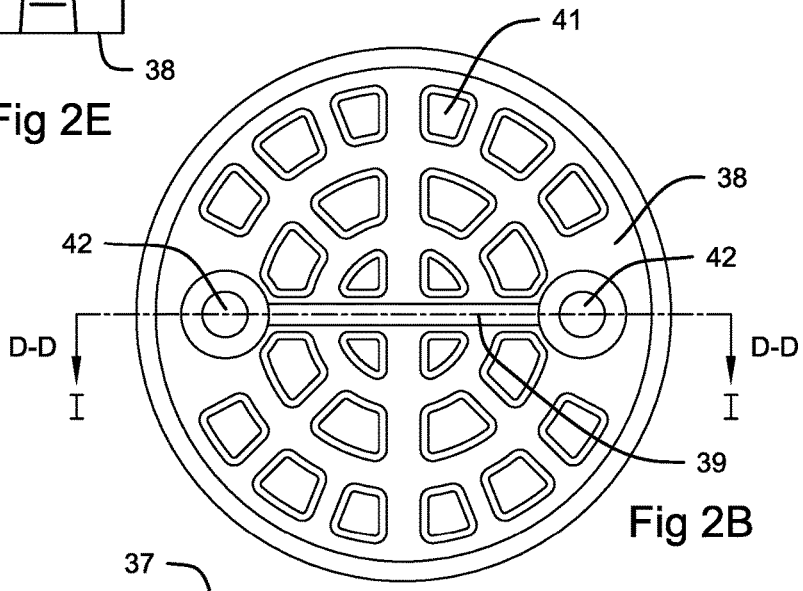
FIG. 2B is a bottom view of the improved strainer of FIG. 2 illustrating a channel having two cavities at its opposite end sections sized to operatively receive the threaded securing posts of the FIG. 2 securing member.
Figure 2C:
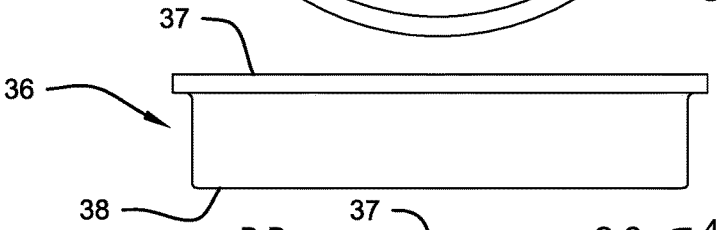
FIG. 2C is a side view of the improved strainer illustrated in FIG. 2
Figure 2D:
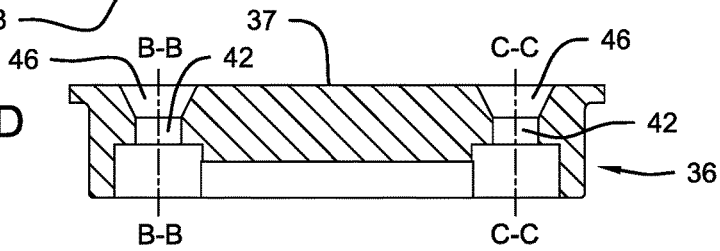
FIG. 2D is a cross-sectional view taken along lines 2D-2D of FIG. 2A illustrating the preferred shape of the channel and screw passageways upper seating cavities.
Figure 3A:
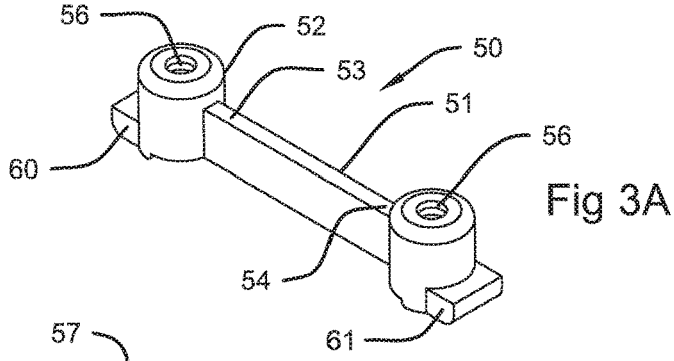
FIG. 3A is a three-quarter perspective view of the securing member illustrated in FIG. 2.
Figure 3B:
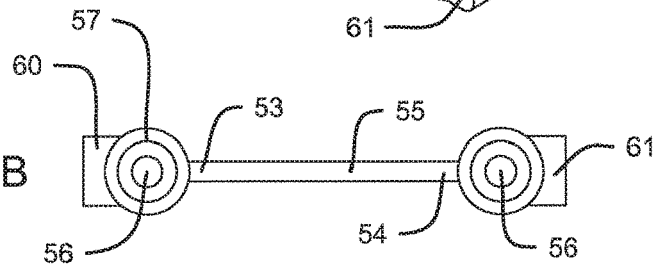
FIG. 3B is a top view of the improved securing member illustrated in FIG. 3A.
Figure 3C:
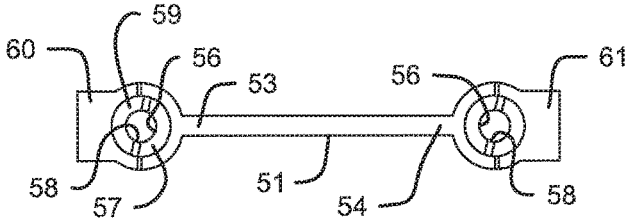
FIG. 3C is a bottom view of the improved securing bar illustrated in FIG. 3A.
Figure 3D:
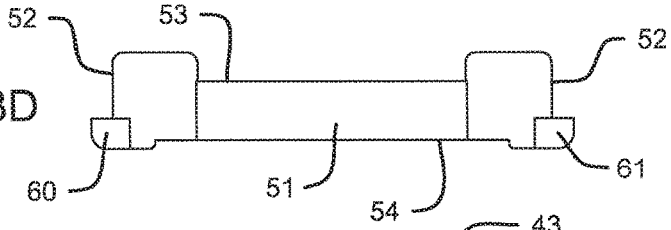
FIG. 3D is a side view of the improved securing bar illustrated in FIG. 3A.

As seen in FIGS. 5A-5D if only one tamper resistant screw 43 is to be used, it is preferred that the screw passageway 42 be positioned along the central vertical axis "A-A" of the strainer body 36. As seen in FIGS. 2A-2B, and FIG. 2D, if two or more tamper resistant screws 43 are to be used, it is preferred that two of the screw passageways 42 be position along a vertical axis "B-B" and "C-C", respectively, in the opposite end sections of a horizontal diameter line axis "D-D" of strainer body 36.

As seen in FIGS. 3A-3D, the strainer assembly 3 also comprises a strainer securing member 50. The securing member of a conventional drainage system as shown in FIG. 1 can be used to operatively attach the metal plate 22 to the ledge 29. However, it is preferred that the novel strainer securing member 51 of this invention, seen in FIGS. 3A-3D (two screw configuration) or as seen in FIGS. 5A-5C and FIGS. 6A-6D or in FIG. 6E (one screw configuration), be used.

In FIGS. 3A-3D strainer securing member 50 comprises a mid-section 51 having a post member 52 affixed at each opposing end sections 53, 54 of mid-section 51. Preferably, each post member 52 will be wider than the mid-section 51 and extend above the top surface 55 of the mid-section 51. Each post member 52 contains a threaded passageway 56 sized to operatively receive the threaded end 45 of corresponding screw 43. In a more preferred embodiment a metal cylinder 57 having a threaded interior wall 58 will be pressed or otherwise fixed in a non-threaded passageway 59 to provide additional stability and strength to the securing member 50. The securing member 50 also comprises shoulder members 60, 61 extending from the opposing ends of mid-sections 51/post members 52. The shoulder members 60, 61 are sized to pass through ledge gaps 32, 33 and pass under ledge 29 to contact ledge bottom surface 31 when the strainer assembly 3 is rotated to position the shoulder members 60, 61 underneath ledge 29.

As seen in FIGS. 5A-5B and FIGS. 6A-6D, if only one tamper resistant screw 43 is to be used, it is preferred that the strainer screw passageway 42 be positioned in the center vertical axis "A-A" of strainer body 36. Likewise, it would be preferred that the threaded interior wall 58 be positioned in the center vertical axis "A-A" of the mid-section 51 whereby the screw passageway 41 and the threaded interior wall 58 are in alignment.

When the preferred securing assembly 3 is utilized, it is preferred that the bottom surface 38 of the strainer body 36 be provided with a channel 39 and post receiving cavities 40, preferable running along the diameter of the strainer body bottom surface 38 and in alignment with the post members 52. The channel 39 and its post receiving cavities 40 are sized and shaped to receive the securing member 50 so as to align the strainer body screw passageway 42 and the post threaded passageway 52 for easier insertion and threading of the tamper resistant screws 43, as well as easier engagement of the securing member 50 with the securing ring ledge 29.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What we claim is:

1. A strainer assembly for use in a sink drain system provided with a drain opening and having a drain assembly including a waste valve having an interior intake wall section threaded to receive an exterior wall section of a securing ring, wherein the securing ring exterior wall forms a passageway having an upper lip sized and configured to be seated around the perimeter of the drain opening; and the passageway having a ledge extending inward from the wall section positioned at a known distance from the upper lip, the ledge forming an opening; the ledge having opposing access gaps and extending horizontally inward from the side walls and into the passageway, the strainer assembly comprising:

a. a strainer having a body sized to fit within the securing ring passageway and adjacent the walls of the securing ring; the body having a top surface when positioned in the securing ring passageway being flush with the upper lip and a bottom surface when positioned in the securing ring passageway being adjacent the ledge; the body having multiple drain passageways extending from the top surface to the bottom surface of the body; the body having at least one screw passageway extending from the top surface to the bottom surface; the strainer body further comprising a channel extending across the bottom surface of the body;

b. a securing member comprising an elongated member having opposed end sections; each end section having a width less than the access gaps in the ledge, the securing member having a length sufficient to position the end sections under the ledge; the elongated member having at least one threaded opening aligned with the at least one screw passageway of the strainer body; the elongated member when attached to the body of the strainer being sized to permit the opposing end sections to pass through access gaps in the ledge and when rotated to contact a bottom surface of the ledge; and c. at least one screw having a threaded shank of sufficient length to extend through the strainer body screw passageway for operative attachment to the securing member threaded opening;

d. wherein the channel in the bottom surface of the strainer body is sized and configured to receive the securing member and wherein the at least one screw, the channel and the securing member are sized and configured to bring the securing member within the channel and the opposing end sections into close contact with the ledge when the end sections are under the ledge and the screw is tightened.

2. The strainer system according to claim 1 wherein the elongated member having at least one post section extending above the elongated member top surface and positioned adjacent one of the opposing end sections, whereby the at least one post section having a threaded opening aligned with the screw passageway of the strainer body.

3. The strainer system according to claim 2 wherein the post section is wider than the top surface of the elongated member.

4. The strainer system according to claim 1 wherein the drain passageways are unobstructed and shaped to resemble a truncated inverted tapered polygon with a wider base in the bottom surface and a narrower truncated top in the top surface.

5. The strainer system according to claim 4 wherein the multiple fluid passageways having individual cross-sectional areas to permit fluid and solid particles having a diameter less than ½ inch to flow through the passageways.

6. The strainer system according to claim 2 wherein a. the screw passageway extends through the body bottom surface at a horizontal diameter axis of the bottom surface and b. wherein the channel extends horizontally along the horizontal diameter axis, the channel shaped and sized to contain the post section in a position to permit alignment of the screw and the securing member threaded opening.

7. The strainer system according to claim 1 wherein the screw passageway has a top section, the top section of the screw passageway comprising a screw head cavity, and wherein the at least one screw is a tamper resistant screw.

8. The strainer according to claim 7 wherein the screw has a flat head sized to be level with the top surface when the flat heat is seated in the screw head opening.

9. The strainer system according to claim 7 wherein the post section is wider than the top surface of the elongated member.

10. A strainer assembly for use in a sink drain system having a drain assembly including a waste valve having an interior intake wall section threaded to receive an exterior wall section of a securing ring, wherein the securing ring exterior wall forms a passageway and has a ledge having opposing access gaps and extending horizontally inward from the side walls and into the passageway, the strainer assembly comprising:

a. a strainer having a body sized to fit within the securing ring passageway and adjacent the walls of the securing ring; the body having a top surface and a bottom surface; the body having multiple unobstructed drain passageways extending from the top surface to the bottom surface of the body; the body having two screw passageways extending from the top surface to the bottom surface wherein the top surface of each screw passageway comprises a screw head cavity and the bottom surface of each screw passageway comprises a securing member post cavity; each of the two screw passageways located in a perimeter area of the top surface opposite one another and positioned in a horizontal diameter axis of the top surface and wherein each of the two screw passageways extend through the body bottom surface at a horizontal diameter axis of the bottom surface and;

b. a securing member comprising an elongated member having a top surface and a bottom surface; the elongated member having two post sections each having a vertical axis and each having a threaded opening along the vertical axis of the corresponding post section; each of the post sections positioned to align with a corresponding screw passageway of the strainer body; the elongated member having opposed end sections sized to permit passage through the access openings in the ledge and when rotated to contact a bottom surface of the ledge; and c. one screw for each screw passageway; each of the screw head openings having a vertical axis and a vertically extending guide member extending from the bottom of the screw head opening along the vertical axis of the opening; and d. wherein the body bottom surface contains a channel extending horizontally along the horizontal diameter axis, the channel shaped and sized to contain the securing member and the post section in a position to permit alignment of the screw and the securing member threaded opening.

11. The strainer system according to claim 10 wherein the screw has a flat head sized to be level with the top surface when the flat head is seated in the screw head opening.

12. The strainer system according to claim 10 wherein the post section is wider than the top surface of the elongated member.

13. The strainer system according to claim 7 wherein the at least one screw has a generally hex-shaped screw head opening having a vertical axis, said screw head sized to fit within the screw head cavity; the screw head opening having a vertically extending guide member extending from the bottom of the screw head opening along the vertical axis of the opening.

14. A strainer assembly for use in a sink drain system provided with a drain opening and having a drain assembly including a waste valve having an interior intake wall section threaded to receive an exterior wall section of a securing ring, wherein the securing ring exterior wall forms a passageway having an upper lip sized and configured to be seated around the perimeter of the drain opening; the passageway having a ledge extending inward from the wall section positioned at a known distance from the upper lip, the ledge forming an opening; the ledge having opposing access gaps and extending horizontally inward from the side walls and into the passageway, the strainer assembly comprising:

a. a strainer having a body sized to fit within the securing ring passageway and adjacent the walls of the securing ring; the body having a top surface when positioned in the securing ring passageway being flush with the upper lip and a bottom surface when positioned in the securing ring passageway being adjacent the ledge; the body having multiple drain passageways extending from the top surface to the bottom surface of the body wherein at least one of the drain passageways is of smaller area at the top surface than at the bottom surface; the body having at least one screw passageway extending from the top surface to the bottom surface; the strainer body further comprising a channel extending across the bottom surface of the body;

b. a securing member comprising an elongated member having opposed end sections; each end section having a width less than the access gaps in the ledge, the securing member having a length sufficient to position the end sections under the ledge; the elongated member having at least one threaded opening aligned with the at least one screw passageway of the strainer body; the elongated member when attached to the body of the strainer being sized to permit the opposing end sections to pass through access gaps in the ledge and when rotated to contact a bottom surface of the ledge; and c. at least one screw having a threaded shank of sufficient length to extend through the strainer body screw passageway for operative attachment to the securing member threaded opening;

d. wherein the channel in the bottom surface of the strainer body is sized and configured to receive the securing member and wherein the at least one screw, the channel and the securing member are sized and configured to bring the securing member within the channel and the opposing end sections into close contact with the ledge when the end sections are under the ledge and the screw is tightened.

* * * * *